US011600925B2

(12) United States Patent
Huang

(10) Patent No.: US 11,600,925 B2
(45) Date of Patent: Mar. 7, 2023

(54) ANTENNA STRUCTURE

(71) Applicant: Wistron NeWeb Corp., Hsinchu (TW)

(72) Inventor: Chun-Lin Huang, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 0 days.

(21) Appl. No.: 17/335,329

(22) Filed: Jun. 1, 2021

(65) Prior Publication Data

US 2022/0021118 A1 Jan. 20, 2022

(30) Foreign Application Priority Data

Jul. 20, 2020 (TW) ..... 109124394

(51) Int. Cl.

| | |
|---|---|
| ***H01Q 7/04*** | (2006.01) |
| ***H01Q 9/42*** | (2006.01) |
| ***H01Q 13/10*** | (2006.01) |
| ***H01Q 7/00*** | (2006.01) |

(52) U.S. Cl.

CPC ..... *H01Q 7/04* (2013.01); *H01Q 7/00* (2013.01); *H01Q 9/42* (2013.01); *H01Q 13/10* (2013.01)

(58) Field of Classification Search

CPC .. H01Q 1/36; H01Q 1/38; H01Q 5/10; H01Q 5/20; H01Q 5/307; H01Q 5/385; H01Q 7/00; H01Q 7/04; H01Q 9/30; H01Q 9/42; H01Q 13/10

See application file for complete search history.

(56) References Cited

U.S. PATENT DOCUMENTS

| | | | | |
|---|---|---|---|---|
| 9,490,541 | B2 * | 11/2016 | Tayama | H01Q 5/357 |
| 2010/0156736 | A1 * | 6/2010 | Chung | H01Q 1/2208 343/793 |

FOREIGN PATENT DOCUMENTS

| | | | |
|---|---|---|---|
| CN | 206650166 U | * | 11/2017 |
| CN | 206650166 U | | 11/2017 |
| CN | 108987919 A | * | 12/2018 |
| CN | 109687121 A | * | 4/2019 |
| KR | 100724491 B1 | * | 6/2007 |
| KR | 20220050589 A | * | 4/2022 |

* cited by examiner

*Primary Examiner* — Ab Salam Alkassim, Jr.
*Assistant Examiner* — Leah Rosenberg
(74) *Attorney, Agent, or Firm* — McClure, Qualey & Rodack, LLP

(57) ABSTRACT

An antenna structure includes a loop radiation element, a balance radiation element, a first additional radiation element, and a second additional radiation element. The loop radiation element has a first feeding point. The balance radiation element has a second feeding point. The balance radiation element is coupled to at least a first connection point on the loop radiation element. The balance radiation element is substantially surrounded by the loop radiation element. The first additional radiation element is coupled to a second connection point on the loop radiation element. The second additional radiation element is coupled to a third connection point on the loop radiation element. The loop radiation element is disposed between the first additional radiation element and the second additional radiation element.

20 Claims, 9 Drawing Sheets

600

700

800

ANTENNA STRUCTURE

CROSS REFERENCE TO RELATED APPLICATIONS

This Application claims priority of Taiwan Patent Application No. 109124394 filed on Jul. 20, 2020, the entirety of which is incorporated by reference herein.

BACKGROUND OF THE INVENTION

Field of the Invention

The disclosure generally relates to an antenna structure, and more particularly, to an almost isotropic antenna structure.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz, and 5.8 GHz.

Wireless access points are indispensable elements that allow mobile devices in a room to connect to the internet at high speeds. However, since indoor environments exhibit serious signal reflection and multipath fading, wireless access points should process signals in a variety of directions simultaneously. Accordingly, it has become a critical challenge for antenna designers to design an almost isotropic antenna in the limited space of a wireless access point.

BRIEF SUMMARY OF THE INVENTION

In an exemplary embodiment, the invention is directed to an antenna structure that includes a loop radiation element, a balance radiation element, a first additional radiation element, and a second additional radiation element. The loop radiation element has a first feeding point. The balance radiation element has a second feeding point. The balance radiation element is coupled to at least a first connection point on the loop radiation element. The balance radiation element is substantially surrounded by the loop radiation element. The first additional radiation element is coupled to a second connection point on the loop radiation element. The second additional radiation element is coupled to a third connection point on the loop radiation element. The loop radiation element is disposed between the first additional radiation element and the second additional radiation element.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

Figure 1:
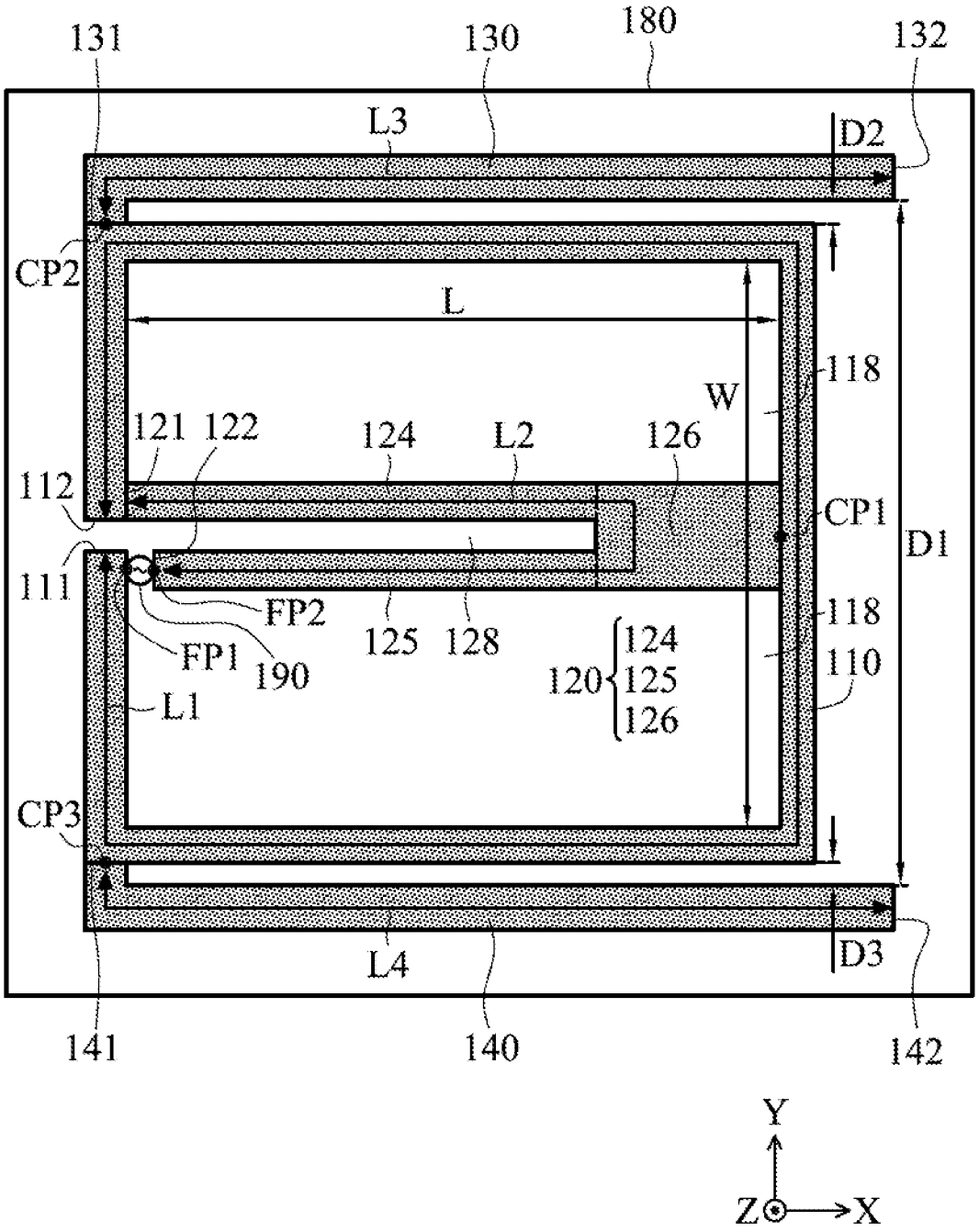
FIG. 1 is a diagram of an antenna structure according to an embodiment of the invention.

In order to illustrate the foregoing and other purposes, features and advantages of the invention, the embodiments and figures of the invention will be described in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

FIG. 1 is a diagram of an antenna structure 100 according to an embodiment of the invention. The antenna structure 100 may be applied to a communication device, such as a wireless access point. As shown in FIG. 1, the antenna structure 100 at least includes a loop radiation element 110, a balance radiation element 120, a first additional radiation element 130, and a second additional radiation element 140. The loop radiation element 110, the balance radiation element 120, the first additional radiation element 130, and the second additional radiation element 140 may all be made of metal materials, such as copper, silver, aluminum, iron, or their alloys.

In some embodiments, the antenna structure 100 further includes a dielectric substrate 180. The loop radiation element 110, the balance radiation element 120, the first additional radiation element 130, and the second additional radiation element 140 may form a planar structure disposed on the same surface of the dielectric substrate 180. For example, the dielectric substrate 180 may be an FR4 (Flame Retardant 4) substrate, a PCB (Printed Circuit Board), or an FCB (Flexible Circuit Board). However, the invention is not limited thereto. In alternative embodiments, the loop radiation element 110, the balance radiation element 120, the first additional radiation element 130, and the second additional radiation element 140 may be disposed on different surfaces (e.g., a top surface and a bottom surface which are opposite to each other) of the dielectric substrate 180, respectively, and they are coupled to each other by one or more conductive via elements (not shown), without affecting the performance of the invention.

The loop radiation element 110 may substantially have a hollow rectangular shape. A hollow portion 118 is formed in the loop radiation element 110. Specifically, the loop radiation element 110 has a first end 111 and a second end 112. A first feeding point FP1 is positioned at the first end 111 of the loop radiation element 110. The first feeding point FP1 may be coupled to a positive electrode of a signal source 190. For example, the signal source 190 may be an RF (Radio Frequency) module for exciting the antenna structure 100. Furthermore, the second end 112 and the first end 111 of the loop radiation element 110 may be adjacent to each other. It should be noted that the term "adjacent" or "close" throughout the disclosure means that the distance (or the space) between two corresponding elements is shorter than a predetermined distance (e.g., 5 mm or less), or means that the two corresponding elements touch each other directly (i.e., the aforementioned distance or space between them is reduced to 0). In alternative embodiments, the loop radiation element 110 has a different shape, such as a hollow circular shape, a hollow triangular shape, a hollow trapezoidal shape, or a hollow elliptical shape.

The balance radiation element 120 may substantially have a U-shape, and it is substantially surrounded by the loop radiation element 110. Specifically, the balance radiation element 120 has a first end 121 and a second end 122 which are adjacent to each other. A second feeding point FP2 is positioned at the second end 122 of the balance radiation element 120. The second feeding point FP2 may be coupled to a negative electrode of the signal source 190. In some embodiments, the balance radiation element 120 includes a first branch portion 124, a second branch portion 125, and a connection portion 126. The first branch portion 124 is adjacent to or includes the first end 121 of the balance radiation element 120. The second branch portion 125 is adjacent to or includes the second end 122 of the balance radiation element 120. The connection portion 126 is coupled between the first branch portion 124 and the second branch portion 125. The connection portion 126 is coupled to a first connection point CP1 on the loop radiation element 110. The first connection point CP1 may be substantially positioned at the center of an edge of the loop radiation element 110. In some embodiments, the first branch portion 124 (or the first end 121 of the balance radiation element 120) is further coupled to the second end 112 of the loop radiation element 110. Each of the first branch portion 124 and the second branch portion 125 may substantially have a straight-line shape, and they may be substantially parallel to each other. In addition, a slot 128 may be formed between the first branch portion 124 and the second branch portion 125. In some embodiments, the slot 128 is a monopole slot.

The first additional radiation element 130 may substantially have an L-shape. Specifically, the first additional radiation element 130 has a first end 131 and a second end 132. The first end 131 of the first additional radiation element 130 is coupled to a second connection point CP2 on the loop radiation element 110. The second end 132 of the first additional radiation element 130 is an open end. In some embodiments, the second connection point CP2 is position at a corner of the loop radiation element 110.

The second additional radiation element 140 may substantially have an inverted L-shape. Specifically, the second additional radiation element 140 has a first end 141 and a second end 142. The first end 141 of the second additional radiation element 140 is coupled to a third connection point CP3 on the loop radiation element 110. The second end 142 of the second additional radiation element 140 is an open end. The second end 142 of the second additional radiation element 140 and the second end 132 of the first additional radiation element 130 may substantially extend in the same direction. In some embodiments, the third connection point CP3 is position at another corner of the loop radiation element 110, such that the second connection point CP2, the third connection point CP3, and the first end 111 and the second end 112 of the loop radiation element 110 may be substantially arranged in the same straight line. However, the invention is not limited thereto. In alternative embodiments, the first end 111 and the second end 112 of the loop radiation element 110 are not aligned with each other (or arranged in different straight lines). Furthermore, the loop radiation element 110 and the balance radiation element 120 therein are disposed between the first additional radiation element 130 and the second additional radiation element 140.

In some embodiments, the antenna structure 100 covers an operation frequency band. For example, the operation frequency band may be from 2400 MHz to 2500 MHz, but it is not limited thereto. Therefore, the antenna structure 100 can support at least the wideband operation of WLAN (Wireless Local Area Networks) 2.4 GHz.

Figure 2A:
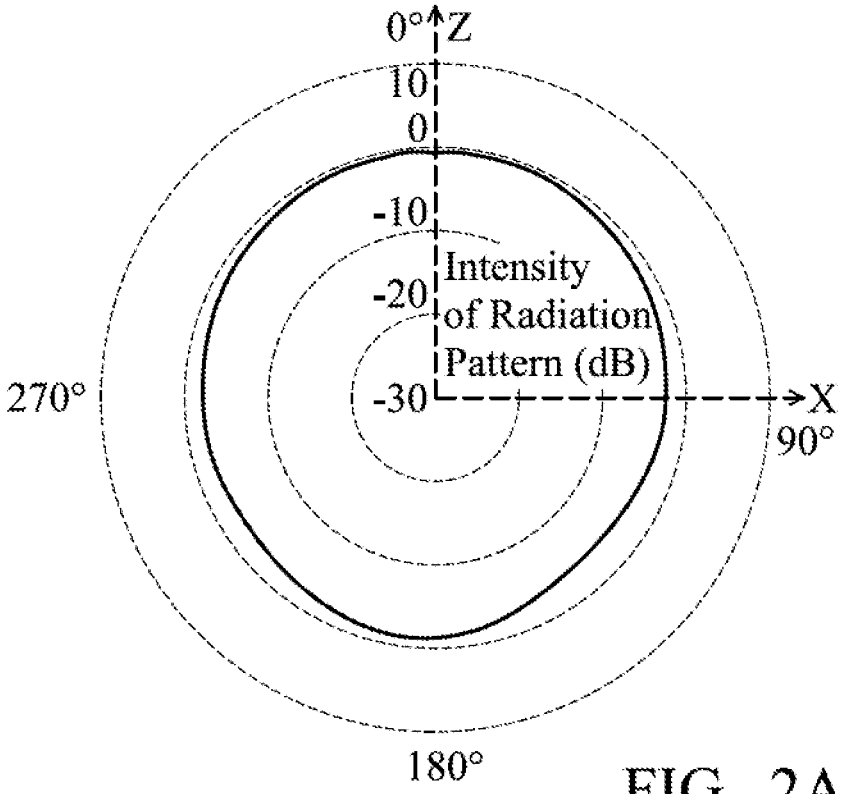
FIG. 2A is a radiation pattern of an antenna structure according to an embodiment of the invention.
Figure 2B:
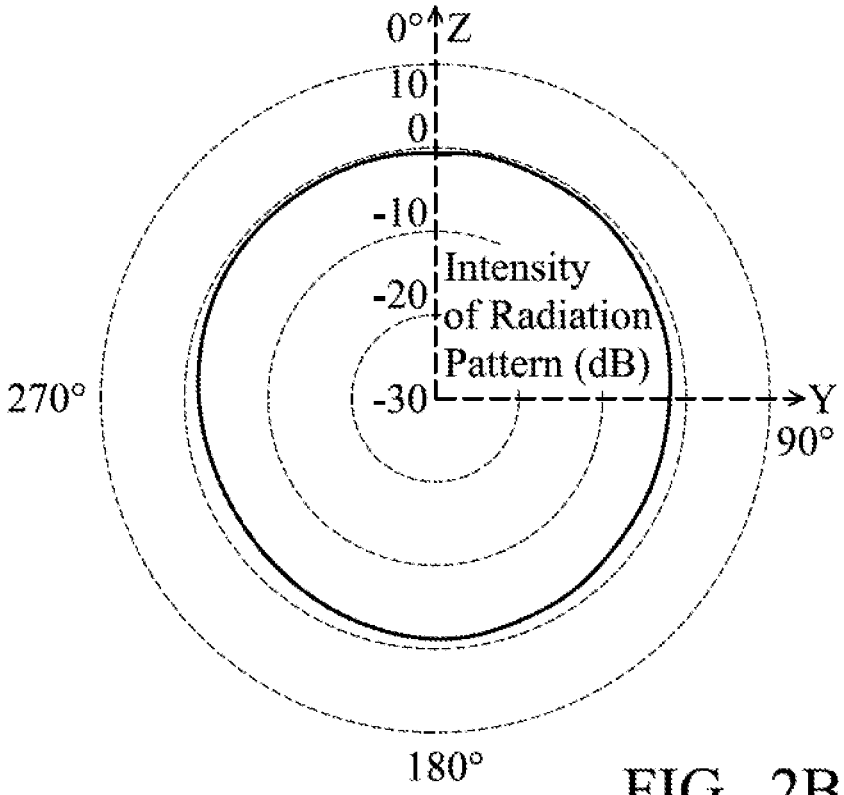
FIG. 2B is a radiation pattern of an antenna structure according to an embodiment of the invention.
Figure 2C:
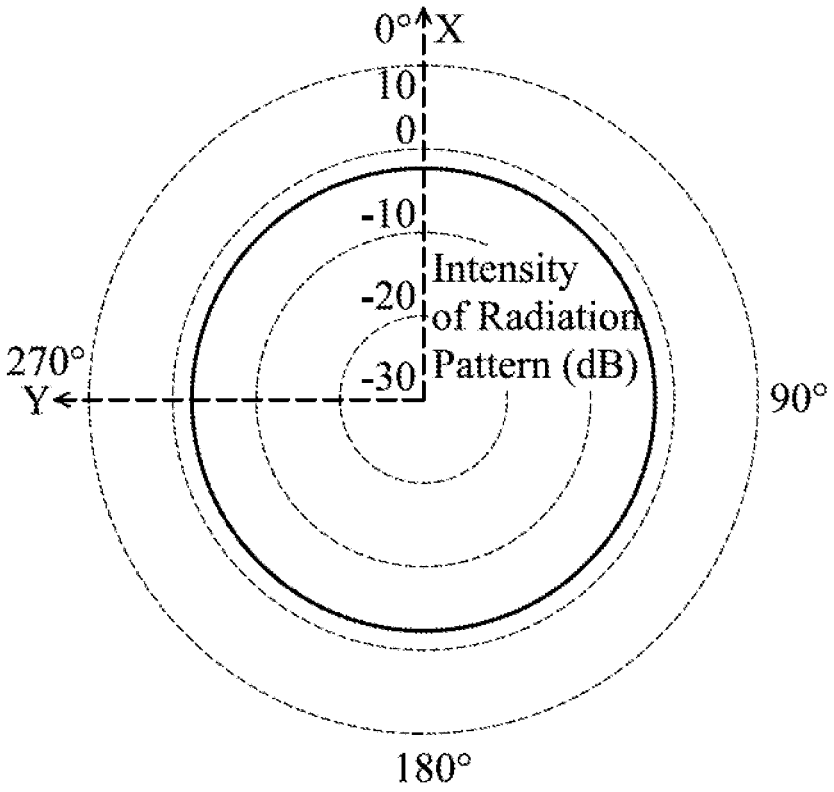
FIG. 2C is a radiation pattern of an antenna structure according to an embodiment of the invention.

FIG. 2A is a radiation pattern of the antenna structure 100 according to an embodiment of the invention, which is measured with respect to the XZ-plane. FIG. 2B is a radiation pattern of the antenna structure 100 according to an embodiment of the invention, which is measured with respect to the YZ-plane. FIG. 2C is a radiation pattern of the antenna structure 100 according to an embodiment of the invention, which is measured with respect to the XY-plane. According to the measurements of FIGS. 2A, 2B and 2C, the antenna structure 100 can generate an almost isotropic radiation pattern.

In some embodiments, the operation principles of the antenna structure 100 are described as follows. When being excited by the signal source 190, the loop radiation element 110 mainly provides vertically-polarized energy distribution (e.g., parallel to the Y-axis), and the first additional radiation element 130 and the second additional radiation element 140 mainly provide horizontally-polarized energy distribution (e.g., parallel to the X-axis), such that the radiation pattern of the antenna structure 100 approaches an ideal isotropic pattern. Furthermore, the incorporation of the balance radiation element 120 can make currents distributed on the antenna structure 100 more uniformly. Thus, it can solve the asymmetrical problem of the first feeding point FP1 and the second feeding point FP2 being both close to the same side of the antenna structure 100.

In some embodiments, the element sizes of the antenna structure 100 are described as follows. The length L1 of the loop radiation element 110 (i.e., the length L1 from the first end 111 through the first connection point CP1 to the second end 112) may be from 0.45 to 0.85 wavelength (0.45λ~0.85λ) of the operation frequency band of the antenna structure 100, such as about 0.65 wavelength (0.65λ). The length L2 of the balance radiation element 120 (i.e., the length L2 from the first end 121 through the connection portion 126 to the second end 122) may be from 0.05 to 0.45 wavelength (0.05λ~0.45λ) of the operation frequency band of the antenna structure 100, such as about 0.25 wavelength (0.25λ). The length L3 of the first additional radiation element 130 (i.e., the length L3 from the first end 131 to the second end 132) may be from 0.11 to 0.31 wavelength (0.11λ~0.31λ) of the operation frequency band of the antenna structure 100, such as about 0.21 wavelength (0.21λ). The length L4 of the second additional radiation element 140 (i.e., the length L4 from the first end 141 to the second end 142) may be from 0.11 to 0.31 wavelength (0.11λ~0.31λ) of the operation frequency band of the antenna structure 100, such as about 0.21 wavelength (0.21λ). The hollow portion 118 of the loop radiation element 110 has a length L and a width W, and its aspect ratio (i.e., L/W) may be from 0.66 to 1.66, such as about 1.16. The first distance D1 is defined as the distance between the second end 132 of the first additional radiation element 130 and the second end 142 of the second additional radiation element 140. The ratio of the first additional radiation element 130's length L3 to the first distance D1 (i.e., L3/D1) may be from 0.6 to 1.6, such as about 1.1. The ratio of the second additional radiation element 140's length L4 to the first distance D1 (i.e., L4/D1) may be from 0.6 to 1.6, such as about 1.1. The second distance D2 is defined as the distance between the loop radiation element 110 and the second end 132 of the first additional radiation element 130. The second distance D2 may be longer than or equal to 0.2 mm. The third distance D3 is defined as the distance between the loop radiation element 110 and the second end 142 of the second additional radiation element 140. The third distance D3 may be longer than or equal to 0.2 mm. The ranges of the element sizes listed above were calculated and obtained according to many experimental results, and they help to optimize the isotropic characteristics, the operation bandwidth, and the impedance matching of the antenna structure 100.

Figure 3:
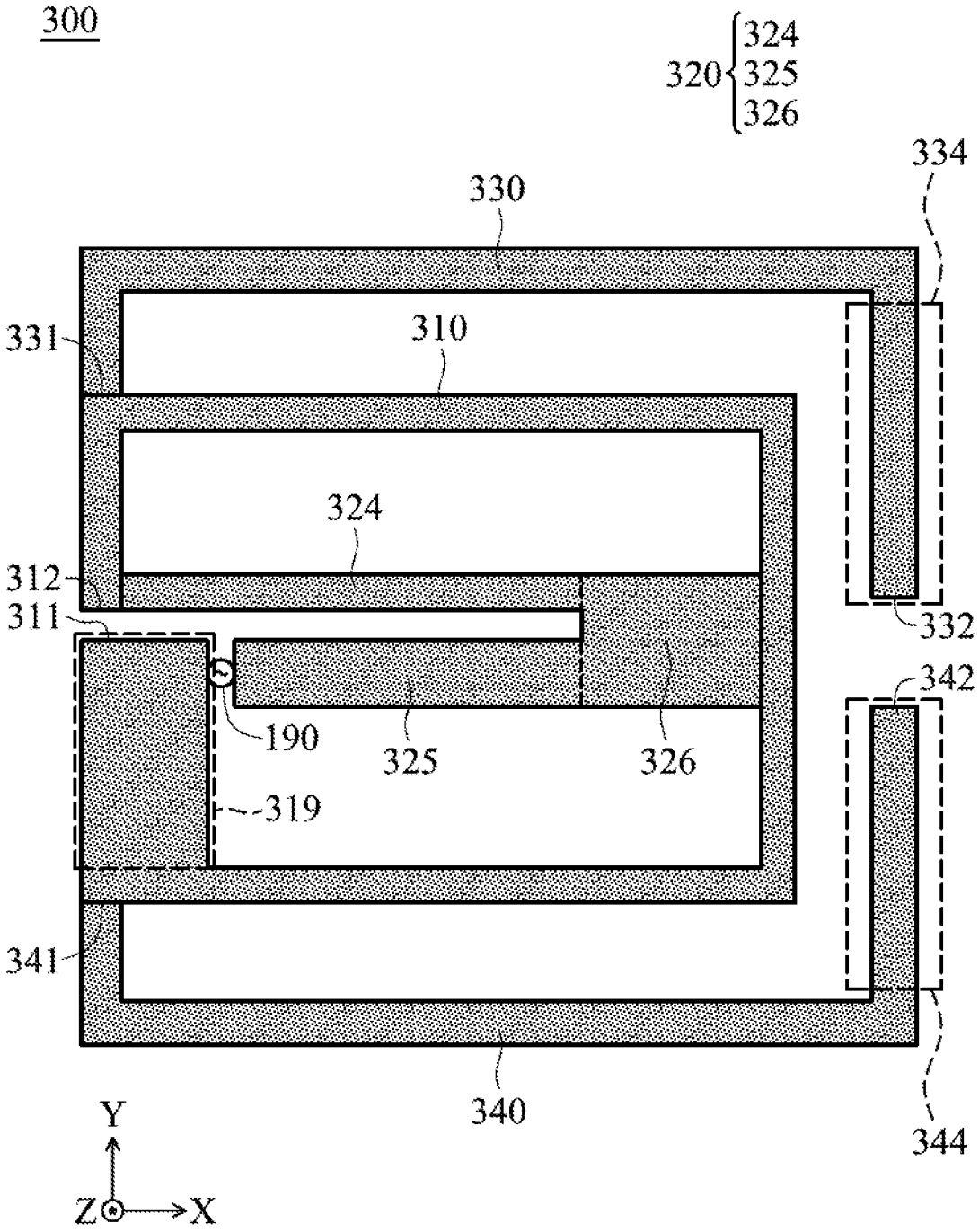
FIG. 3 is a diagram of an antenna structure according to an embodiment of the invention.

FIG. 3 is a diagram of an antenna structure 300 according to an embodiment of the invention. FIG. 3 is similar to FIG. 1. In the embodiment of FIG. 3, the antenna structure 300 includes a loop radiation element 310, a balance radiation element 320, a first additional radiation element 330, and a second additional radiation element 340. Specifically, the loop radiation element 310 has a first end 311 and a second end 312. The loop radiation element 310 further includes a terminal widening portion 319 adjacent to the first end 311. The balance radiation element 320 includes a first branch portion 324, a second branch portion 325, and a connection portion 326. The second branch portion 325 and the connection portion 326 are both widened (in comparison to the embodiment of FIG. 1). According to practical measurements, the aforementioned widening portions can fine-tune the impedance matching of the antenna structure 300. Furthermore, the first additional radiation element 330 has a first end 331 and a second end 332. The first additional radiation element 330 further includes a first terminal bending portion 334 adjacent to the second end 332. Thus, the first additional radiation element 330 substantially has an inverted J-shape. Similarly, the second additional radiation element 340 has a first end 341 and a second end 342. The second additional radiation element 340 further includes a second terminal bending portion 344 adjacent to the second end 342. Thus, the second additional radiation element 340 substantially has a J-shape. The second end 332 of the first additional radiation element 330 and the second end 342 of the second additional radiation element 340 may substantially extend toward each other. According to practical measurements, the aforementioned terminal bending portions not only increases the operation bandwidth of the antenna structure 300 but also minimizes the whole size of the antenna structure 300. Other features of the antenna structure 300 of FIG. 3 are similar to those of the antenna structure 100 of FIG. 1. Accordingly, the two embodiments can achieve similar levels of performance.

Figure 4:
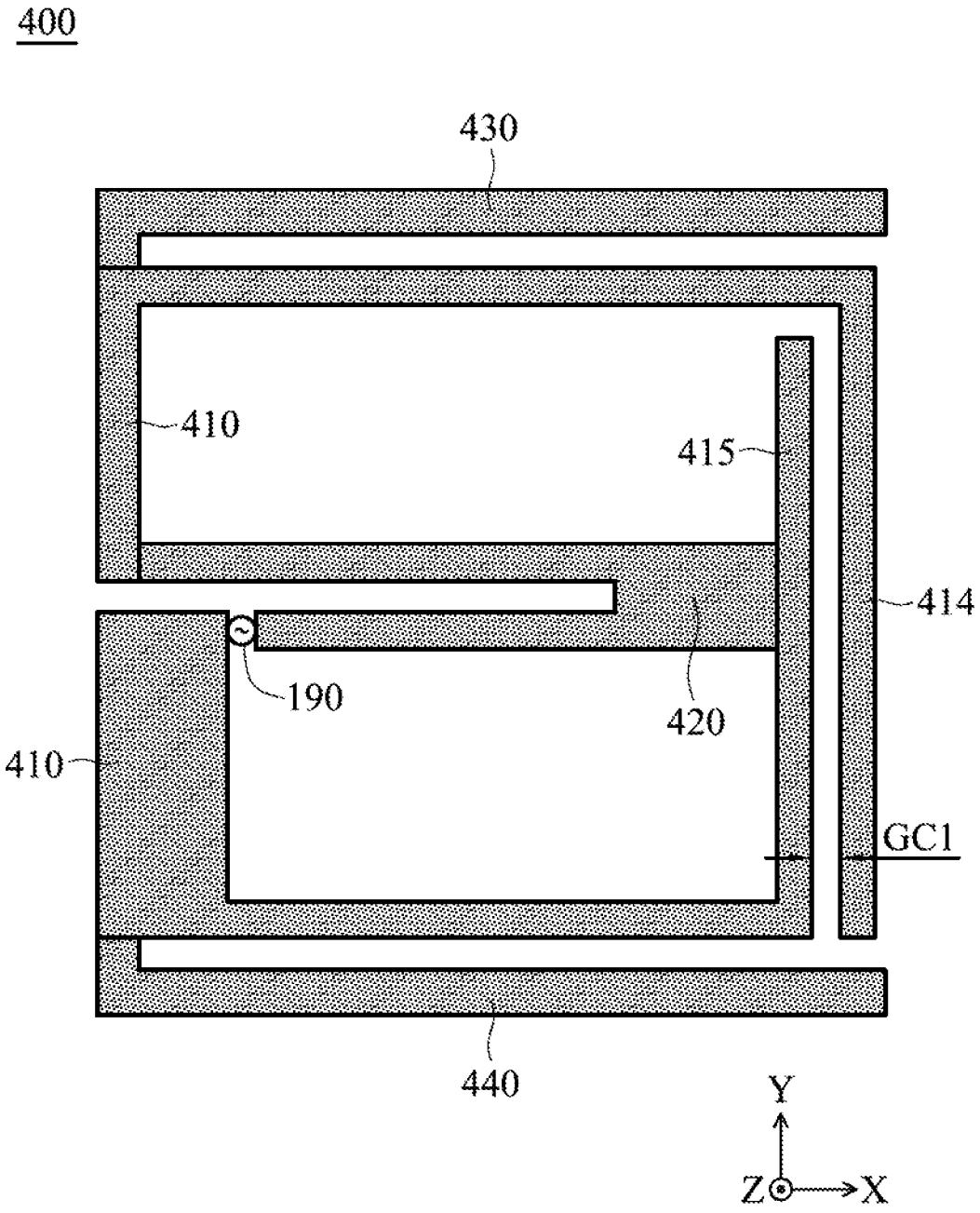
FIG. 4 is a diagram of an antenna structure according to an embodiment of the invention.

FIG. 4 is a diagram of an antenna structure 400 according to an embodiment of the invention. FIG. 4 is similar to FIG. 1. In the embodiment of FIG. 4, the antenna structure 400 includes a loop radiation element 410, a balance radiation element 420, a first additional radiation element 430, and a second additional radiation element 440. It should be noted that the loop radiation element 410 further includes a first coupling portion 414 and the second coupling portion 415 which are separate from each other, and a coupling gap GC1 is formed between the first coupling portion 414 and the second coupling portion 415. For example, the open end of the first coupling portion 414 may extend in the direction of the −Y-axis, and the open end of the second coupling portion 415 may extend in the direction of the +Y-axis. The width of the coupling gap GC1 may be longer than or equal to 0.2 mm. According to practical measurements, even if the loop radiation element 410 has a partial disconnection design (with the coupling gap GC1), it can still provide an almost isotropic radiation pattern. Other features of the antenna structure 400 of FIG. 4 are similar to those of the antenna structure 100 of FIG. 1. Accordingly, the two embodiments can achieve similar levels of performance.

Figure 5:
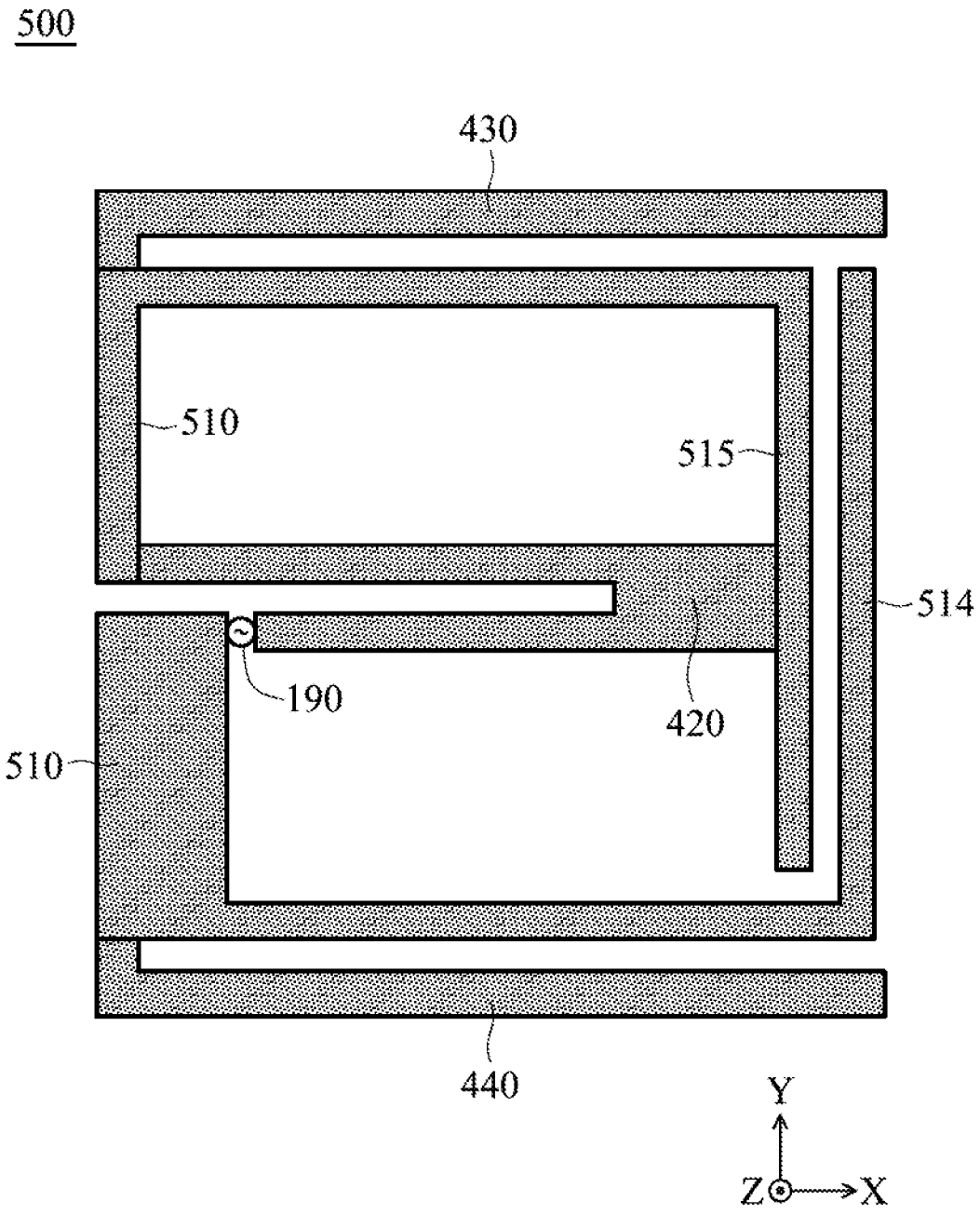
FIG. 5 is a diagram of an antenna structure according to an embodiment of the invention.

FIG. 5 is a diagram of an antenna structure 500 according to an embodiment of the invention. FIG. 5 is similar to FIG. 4. The difference between the two embodiments is that a first coupling portion 514 and a second coupling portion 515 of a loop radiation element 510 of the antenna structure 500 have different extension directions. For example, the open end of the first coupling portion 514 may extend in the direction of the +Y-axis, and the open end of the second coupling portion 515 may extend in the direction of the −Y-axis. Other features of the antenna structure 500 of FIG. 5 are similar to those of the antenna structure 400 of FIG. 4. Accordingly, the two embodiments can achieve similar levels of performance.

Figure 6:
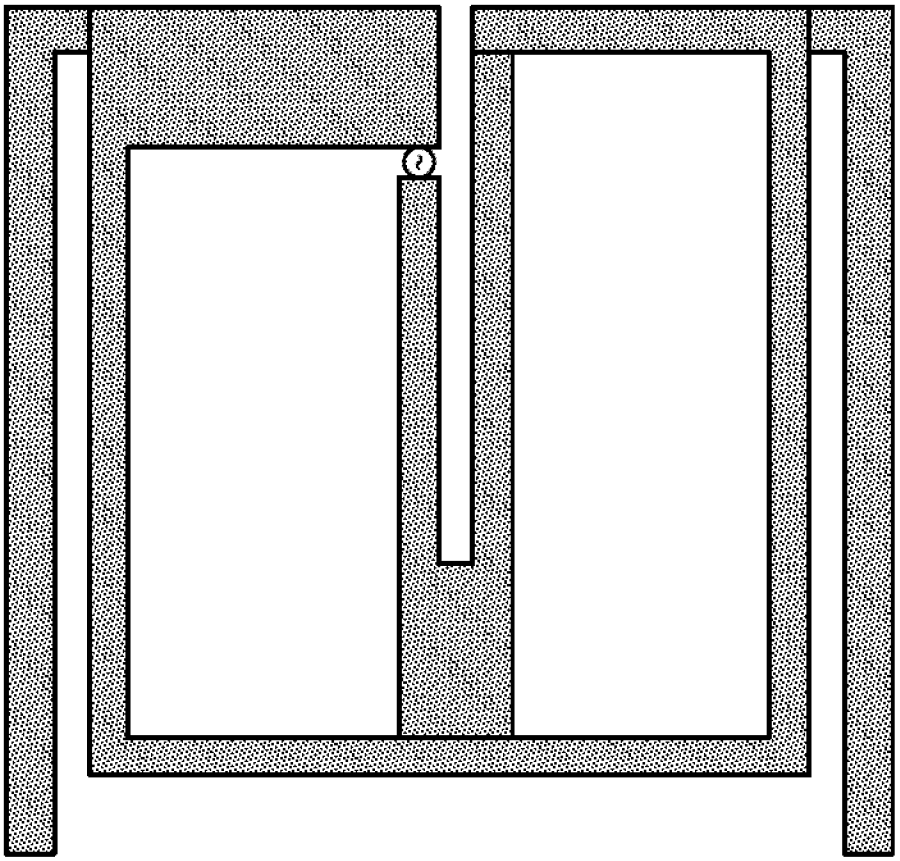
FIG. 6 is a diagram of an antenna structure according to an embodiment of the invention.
Figure 7:
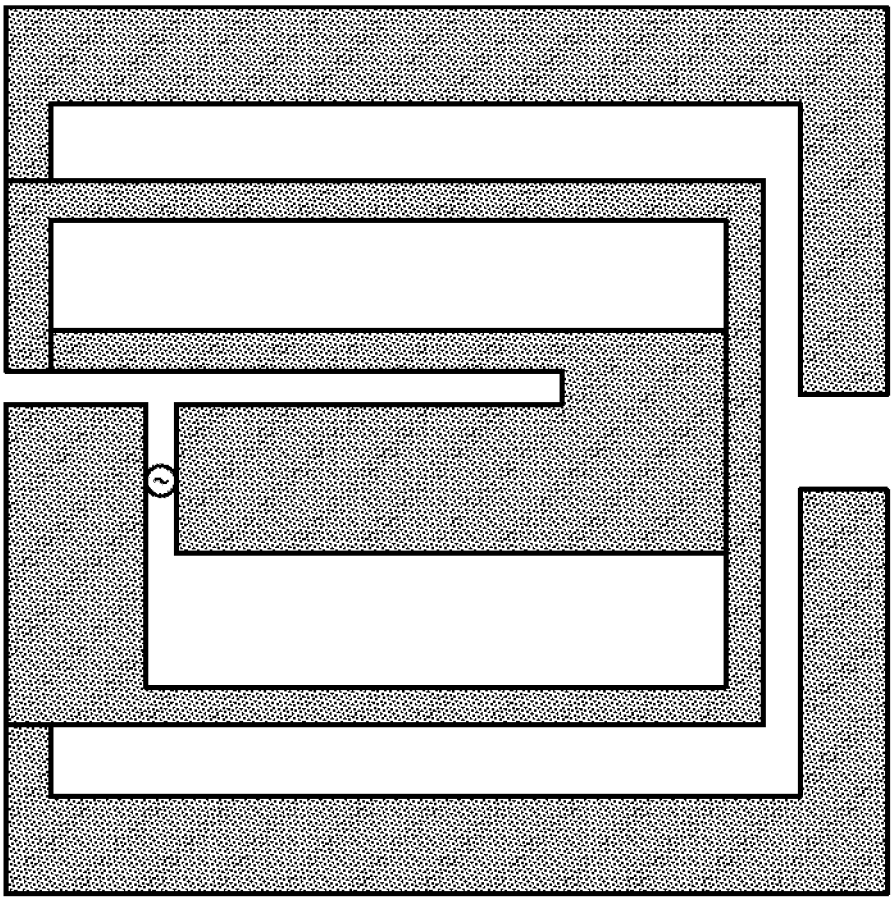
FIG. 7 is a diagram of an antenna structure according to an embodiment of the invention.
Figure 8:
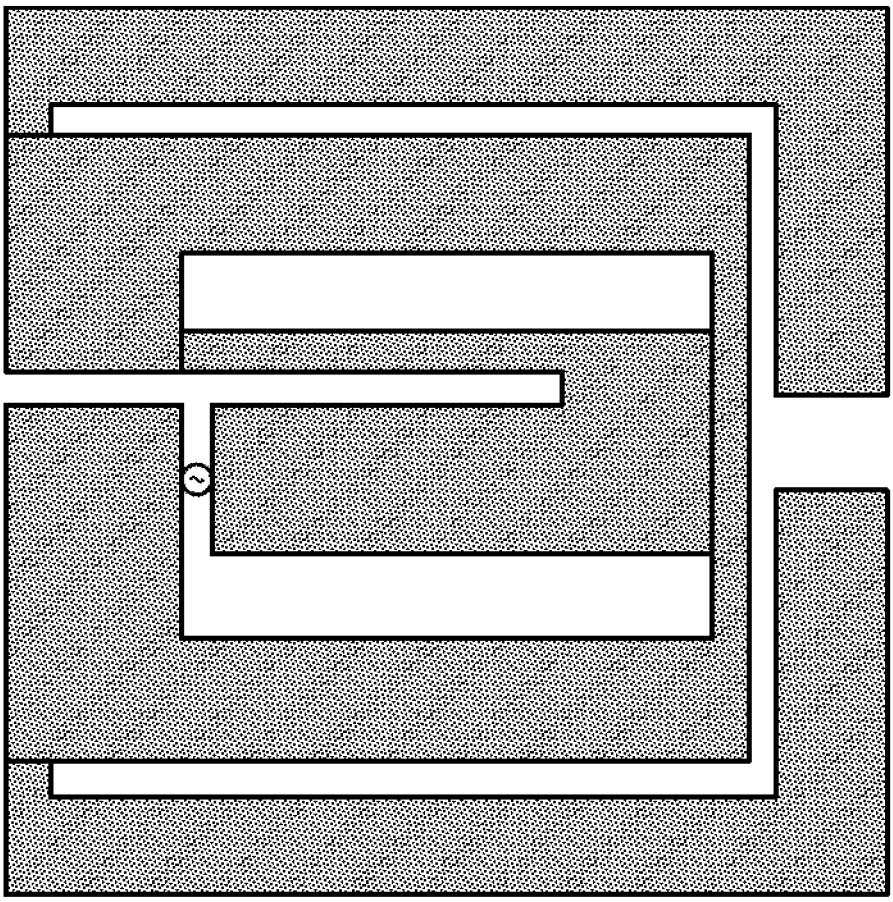
FIG. 8 is a diagram of an antenna structure according to an embodiment of the invention.

FIG. 6 is a diagram of an antenna structure 600 according to an embodiment of the invention. FIG. 7 is a diagram of an antenna structure 700 according to an embodiment of the invention. FIG. 8 is a diagram of an antenna structure 800 according to an embodiment of the invention. According to practical measurements, if all or portions of the radiation elements are widened, the impedance matching of the corresponding antenna structure can be fine-tuned, and the almost isotropic radiation pattern can be maintained. Other features of the antenna structures 600, 700 and 800 of FIGS. 6, 7 and 8 are similar to those of the antenna structures 100 and 300 of FIGS. 1 and 3. Accordingly, these embodiments can achieve similar levels of performance.

The invention proposes a novel antenna structure. In comparison to the conventional design, the invention has at least the advantages of isotropic characteristics, small size, wide bandwidth, and planar design, and therefore it is suitable for application in a variety of mobile communication devices.

Note that the above element sizes, element shapes, and frequency ranges are not limitations of the invention. An antenna designer can fine-tune these settings or values according to different requirements. It should be understood that the antenna structure of the invention is not limited to the configurations of FIGS. 1-8. The invention may include any one or more features of any one or more embodiments of FIGS. 1-8. In other words, not all of the features displayed in the figures should be implemented in the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

It will be apparent to those skilled in the art that various modifications and variations can be made in the invention. It is intended that the standard and examples be considered as exemplary only, with the true scope of the disclosed embodiments being indicated by the following claims and their equivalents.

What is claimed is:

1. An antenna structure, comprising: a loop radiation element, having a first feeding point; a balance radiation element, having a second feeding point, and coupled to at least a first connection point on the loop radiation element, wherein the balance radiation element is substantially surrounded by the loop radiation element; a first additional radiation element, coupled to a second connection point on the loop radiation element; and a second additional radiation element, coupled to a third connection point on the loop radiation element; wherein the loop radiation element is disposed between the first additional radiation element and the second additional radiation element; wherein the antenna structure generates an isotropic radiation pattern wherein the balance radiation element comprises a first branch portion, a second branch portion, and a connection portion, and wherein the connection portion is coupled between the first branch portion and the second branch portion; wherein the connection portion is directly connected to the first connection point.

2. The antenna structure as claimed in claim 1, further comprising:

a dielectric substrate, wherein the loop radiation element, the balance radiation element, the first additional radiation element, and the second additional radiation element are disposed on the dielectric substrate.

3. The antenna structure as claimed in claim 1, wherein the antenna structure covers an operation frequency band from 2400 MHz to 2500 MHz.

4. The antenna structure as claimed in claim 1, wherein the loop radiation element substantially has a hollow rectangular shape.

5. The antenna structure as claimed in claim 1, wherein the loop radiation element has a first end and a second end, and the first feeding point is positioned at the first end of the loop radiation element.

6. The antenna structure as claimed in claim 3, wherein a length of the loop radiation element is from 0.45 to 0.85 wavelength of the operation frequency band.

7. The antenna structure as claimed in claim 1, wherein an aspect ratio of a hollow portion of the loop radiation element is from 0.66 to 1.66.

8. The antenna structure as claimed in claim 1, wherein the loop radiation element further comprises a first coupling portion and a second coupling portion, and a coupling gap is formed between the first coupling portion and the second coupling portion.

9. The antenna structure as claimed in claim 1, wherein the balance radiation element substantially has a U-shape.

10. The antenna structure as claimed in claim 5, wherein a slot is formed between the first branch portion and the second branch portion.

11. The antenna structure as claimed in claim 10, wherein the first branch portion of the balance radiation element is further coupled to the second end of the loop radiation element, and the second feeding point is positioned at the second branch portion of the balance radiation element.

12. The antenna structure as claimed in claim 3, wherein a length of the balance radiation element is from 0.05 to 0.45 wavelength of the operation frequency band.

13. The antenna structure as claimed in claim 1, wherein the first additional radiation element substantially has an L-shape.

14. The antenna structure as claimed in claim 3, wherein a length of the first additional radiation element is from 0.11 to 0.31 wavelength of the operation frequency band.

15. The antenna structure as claimed in claim 1, wherein the first additional radiation element further comprises a first terminal bending portion.

16. The antenna structure as claimed in claim 1, wherein the second additional radiation element substantially has an inverted L-shape.

17. The antenna structure as claimed in claim 3, wherein a length of the second additional radiation element is from 0.11 to 0.31 wavelength of the operation frequency band.

18. The antenna structure as claimed in claim 1, wherein the second additional radiation element further comprises a second terminal bending portion.

19. The antenna structure as claimed in claim 1, wherein the first additional radiation element and the second additional radiation element substantially extend in a same direction or toward each other.

20. The antenna structure as claimed in claim 1, wherein the first connection point is substantially positioned at a center of an edge of the loop radiation element.

* * * * *